US008844787B2

(12) United States Patent
Shima et al.

(10) Patent No.: US 8,844,787 B2
(45) Date of Patent: Sep. 30, 2014

(54) FASTENER DRIVING TOOL

(75) Inventors: Yukihiro Shima, Ibaraki (JP); Hideyuki Tanimoto, Ibaraki (JP); Hiroyuki Oda, Ibaraki (JP); Yoshihiro Nakano, Ibaraki (JP); Takashi Ueda, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 477 days.

(21) Appl. No.: 12/352,875

(22) Filed: Jan. 13, 2009

(65) Prior Publication Data

US 2009/0188766 A1 Jul. 30, 2009

(30) Foreign Application Priority Data

Jan. 15, 2008 (JP) ..... 2008-005465

(51) Int. Cl.
*B25C 5/10* (2006.01)
*B25C 1/16* (2006.01)
*B25C 1/06* (2006.01)

(52) U.S. Cl.
CPC ..... *B25C 1/06* (2013.01)
USPC ..... 227/132; 227/134

(58) Field of Classification Search
USPC ..... 227/131, 132, 134
See application file for complete search history.

(56) References Cited

U.S. PATENT DOCUMENTS 3,243,023 A * 3/1966 Boyden ..... 192/223.2
3,563,353 A * 2/1971 LoPresti et al. ..... 192/21
3,682,254 A * 8/1972 Hoeffleur ..... 173/49
3,924,692 A * 12/1975 Saari ..... 173/117
4,161,272 A * 7/1979 Brockl ..... 227/131
4,200,213 A * 4/1980 Liesse ..... 227/10
4,449,660 A * 5/1984 Smith, III ..... 227/8
4,619,162 A * 10/1986 Van Laere ..... 81/464
4,650,007 A * 3/1987 Fujita et al. ..... 173/178
4,724,992 A * 2/1988 Ohmori ..... 227/146
4,834,278 A * 5/1989 Lin ..... 227/7
5,112,256 A * 5/1992 Clement ..... 440/7
5,320,270 A * 6/1994 Crutcher ..... 227/131
5,545,109 A * 8/1996 Hayakawa ..... 477/178

(Continued)

FOREIGN PATENT DOCUMENTS

EP 1 867 439 A1 12/2007
JP 07-205040 A 8/1995
WO WO 2007/142996 A2 12/2007

OTHER PUBLICATIONS

European Search Report issued in European Patent Application No. EP 09 00 0519, dated Apr. 14, 2010.

(Continued)

*Primary Examiner* — Rinaldi I Rada
*Assistant Examiner* — Gloria R Weeks
(74) *Attorney, Agent, or Firm* — McDermott Will & Emery LLP

(57) ABSTRACT

A spring-type fastener driving tool includes a plunger having a blade that drives in fasteners, a spring that urges the plunger downwards and is capable of being compressed upwards, a spring compression mechanism unit that includes a drum that causes the plunger to move in a compression direction of the spring based on rotational force of a motor, a reduction mechanism unit, and a one-way clutch than prohibits reverse rotation of the motor. Reverse rotation of the drum due to the urging force of the spring is prevented by providing the one-way clutch between an input side rotating shaft of the reduction mechanism unit and a rotation output shaft of the motor.

6 Claims, 13 Drawing Sheets

(56) References Cited

U.S. PATENT DOCUMENTS

| | | | | |
|---|---|---|---|---|
| 5,816,121 | A * | 10/1998 | Yoshimizu et al. | 81/469 |
| 5,967,934 | A * | 10/1999 | Ishida et al. | 475/269 |
| 6,070,705 | A * | 6/2000 | Hinterlechner | 192/12 R |
| 6,210,300 | B1 * | 4/2001 | Costin et al. | 475/294 |
| 6,604,666 | B1 * | 8/2003 | Pedicini et al. | 227/131 |
| 6,607,111 | B2 * | 8/2003 | Garvis et al. | 227/131 |
| 6,669,072 | B2 * | 12/2003 | Burke et al. | 227/131 |
| 6,997,367 | B2 * | 2/2006 | Hu | 227/132 |
| 7,506,788 | B2 * | 3/2009 | Liang et al. | 227/133 |
| 7,513,402 | B2 * | 4/2009 | Miyashita et al. | 227/8 |
| 7,513,845 | B2 * | 4/2009 | Ho | 475/298 |
| 7,543,728 | B2 * | 6/2009 | Spasov et al. | 227/132 |
| 7,578,420 | B2 * | 8/2009 | Tanimoto et al. | 227/132 |
| 7,644,783 | B2 * | 1/2010 | Roberts et al. | 173/178 |
| 7,694,863 | B2 * | 4/2010 | Spasov et al. | 227/132 |
| 7,712,546 | B2 * | 5/2010 | Tokunaga | 173/156 |
| 7,789,281 | B2 * | 9/2010 | Tanimoto et al. | 227/131 |
| 8,186,553 | B2 * | 5/2012 | Tanimoto et al. | 227/132 |
| 2008/0006672 | A1 * | 1/2008 | Tanimoto et al. | 227/132 |
| 2008/0017689 | A1 * | 1/2008 | Simonelli et al. | 227/132 |
| 2008/0032848 | A1 * | 2/2008 | Ho | 475/299 |
| 2008/0067213 | A1 * | 3/2008 | Shima et al. | 227/129 |
| 2010/0089963 | A1 * | 4/2010 | Franz et al. | 227/8 |

OTHER PUBLICATIONS

Japanese Notification of Reasons for Rejection, w/ English translation thereof, issued in Japanese Patent Application No. JP 2008-005465 dated Mar. 1, 2013.

Japanese Office Action, and English translation thereof, issued in Japanese Patent Application No. 2008-005465 dated Aug. 29, 2012.

* cited by examiner

ROTATED THROUGH 135 DEGREES

ROTATED THROUGH 270 DEGREES

ROTATED IN REVERSE

CROSS-SECTIONAL VIEW
CUT ALONG Y-Y

FASTENER DRIVING TOOL

BACKGROUND OF THE INVENTION

1. Field of the Invention

The present invention relates to a fastener driving tool for fastening a fastener such as a nail, rivet, or staple to a member to be fastened.

2. Description of the Related Art

In the related art, spring-driven type fastener driving tools employing electric motors are well-known. This type of spring-driven type fastener driving tool uses the drive power of an electric motor to push up a plunger urged by a spring in a direction from a lower dead point to an upper dead point in a fastening direction in resistance to urging force of the spring. The fastener such as a nail is then accelerated in a direction from the upper dead point to the lower dead point by a plunger as a result of the plunger that has been pushed up being released and the fastener is fastened to a member to be fastened.

An electric motor built into a spring-driven type fastener driving tool of the related art drives the plunger from an upper dead point side to an end a position while compressing a spring in resistance to the urging force of the spring using a reduction mechanism provided at a rotation output axis side.

With spring-driven fastener driving tools, in a state of transition after fastening a fastener, the spring is compressed by rotation inertia of a reduction mechanism unit that includes the rotor of a motor and a reduction gear even after a voltage is no longer applied to the electric motor. This means that a mechanism is also required to prevent movement of the plunger in a direction for fastening the fastener as a result of the compressed force of the spring and for preventing movement in the opposite direction to the direction of fastening. Typically, a one-way clutch (reverse rotation prevention mechanism) is provided that prohibits reverse rotation of the rotation output axis of the reduction mechanism unit using urging force (compression force) of the spring when rotation of the motor is stopped.

However, when a spring-driven type fastener driving tool that fastens, for example, larger nails of a length of, for example, 65 millimeters is designed, it is necessary to supply substantial striking power (driving power) to the plunger. It is therefore necessary to make the coil diameter in the spring steel wire diameter of the coil spring large and it is necessary to make urging force (spring force) of the spring with respect to the plunger substantial. However, when the spring force is made large, the drive time taken to move the plunger to the upper dead point becomes substantial. In this event, for example, a time difference occurs between a switch operation time of a trigger switch etc. that permits the firing of a fastening nail and a fastening firing time with a fastener that carries out firing operation that fires a nail every time a nose (push switch) is pressed against a member to be fastened while pulling the trigger switch. This presents a problem that the fastening feeling in response to the fastening switch operation is poor.

In order to resolve this problem, a reduction mechanism unit that reduces high-speed rotation at the motor is connected and a one-way clutch is provided for the reduced rotation output. However, when reverse rotation with respect to the reduction rotation axis is prevented by the urging force of a spring, it is necessary to increase the required allowable torque at the one-way clutch resisting the spring force. This means that a one-way clutch that becomes larger as the spring becomes larger is required. The dimensions and weight of the one-way clutch therefore increase as do the manufacturing costs.

In order to resolve the above situation, it is an object of the present invention to provide a fastener driving tool that can be both small and lightweight because it is not necessary to increase the allowable torque at the one-way clutch.

SUMMARY OF THE INVENTION

In order to achieve the above object, a fastener driving tool of the present invention comprises a motor having a first rotation output shaft, a magazine that supplies fasteners, a plunger, provided to move up and down between an upper dead point and a lower dead point, and having a blade for driving in the fasteners, a spring that urges the plunger downwards, and that is capable of being compressed upwards, a spring compression mechanism unit having a rotating body that moves the plunger in a direction of compressing the spring based on the rotation of the first rotation output shaft of the motor in one direction, a reduction mechanism unit provided between the first rotation output shaft of the motor and the rotating body, having a first rotating input shaft that an output of the first rotation output shaft is transmitted to and a second rotation output shaft connected to the rotating body, that reduces the rotation speed of the first rotating input shaft for outputting to the second rotation output shaft, and a one-way clutch provided between the first rotation output shaft of the motor and the first rotating input shaft of the reduction mechanism unit, that permits rotation of the motor in said one direction that compresses the spring, and prohibits rotation of the motor in an opposite direction.

The reduction mechanism unit reduces the rotational speed of the rotating body to the rotational speed of the first rotation output shaft of the motor or less.

The one-way clutch is connected to the first rotation output shaft of the motor, and the first rotating input shaft of the reduction mechanism unit is connected to the first rotation output shaft of the motor.

The one-way clutch is connected to one end of the first rotation output shaft of the motor, and the first rotating input shaft of the reduction mechanism unit is connected to another end the first rotation output shaft of the motor.

The one-way clutch comprises an inner ring rotation unit connected to the first rotation output shaft of the motor, an outer periphery fixing unit provided at an outer periphery of the inner ring rotation unit, and an engaging member engaging between the inner ring rotation unit and the outer periphery fixing unit, that permits rotation of the inner ring rotation unit in one direction, and prohibits rotation in an opposite direction.

The one-way clutch may be a roller-type one-way clutch.

The one-way clutch may be a ratchet-type one-way clutch.

The allowable torque of the one-way clutch may be set to a range of 5.4 Nm or less.

According to the present invention, it is possible to set allowable torque of a one-way clutch to be small, and it is possible for a fastener driving tool to be both small and lightweight.

BRIEF DESCRIPTION OF THE DRAWINGS

These objects and other objects and advantages of the present invention will become more apparent upon reading of the following detailed description and the accompanying drawings in which:

FIG. 1B is a side cross-section of an embodiment of the one-way clutch constituting the fastener driving tool shown in FIG. 3;

DETAILED DESCRIPTION OF THE PREFERRED EMBODIMENTS

Figure 1:
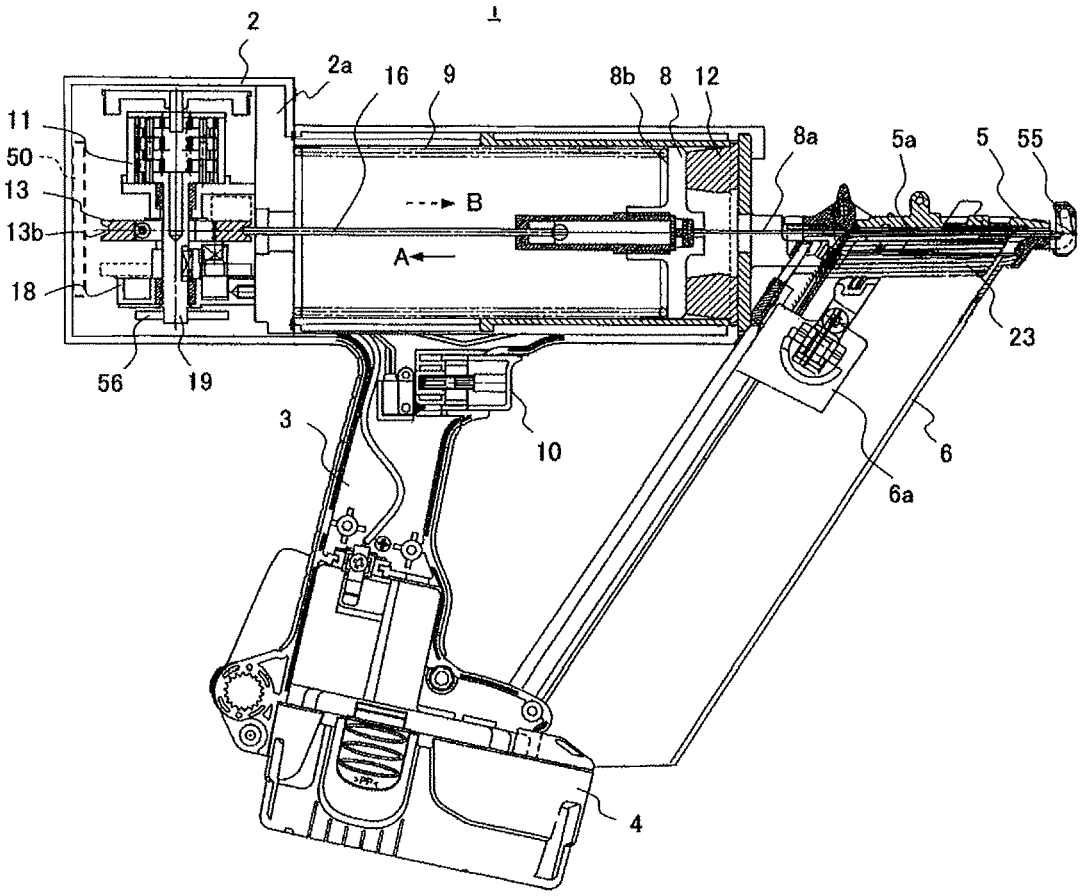
FIG. 1 is a side view including a partial cross-section of a fastener driving tool of a first embodiment of the present invention.
Figure 2:
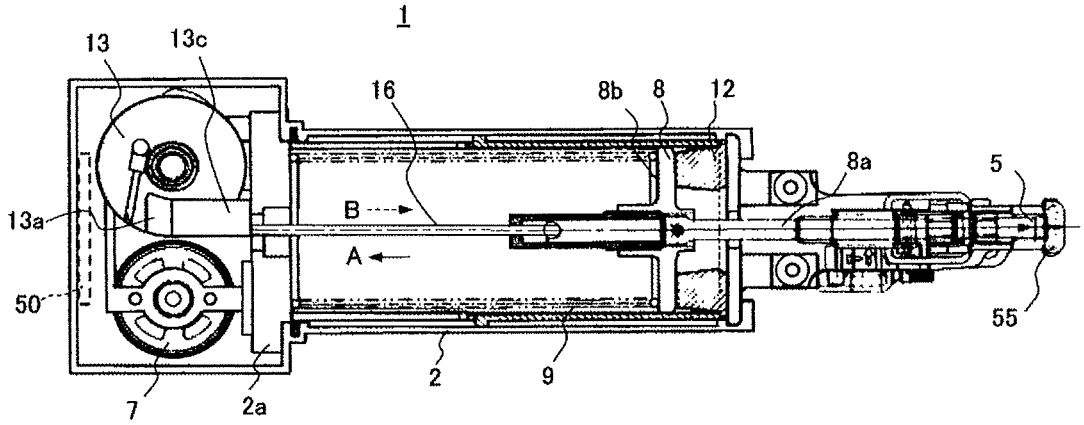
FIG. 2 is a plan view including a partial cross-section of the fastener driving tool shown in FIG. 1.

The following is an explanation with reference to the drawings of the embodiments to which the spring-driven type fastener driving tool of the present invention is applied. In all of the drawings illustrating the embodiments, portions having the same function are given the same numerals and are not repeatedly described. In the following explanation of the fastener driving tool of the present invention, for ease of explanation, the direction in which the fastener is driven is referred to as "downwards" and in the opposite direction to this direction is referred to as "upwards". These expressions of direction are in no way limiting with regards to special embodiments or intentions. The same form expression is also possible when the direction in which the fastener is driven is the vertical direction on the present invention is not in any way limited whatever the direction of driving the fastener is.

FIGS. 1 to 11 show structural views of a fastener driving tool of a first embodiment. First, a description is given of the overall structure of the fastener driving tool with reference to FIGS. 1 to 3.

The fastener driving tool 1 includes a fuselage housing unit 2, a handle housing unit 3, a battery pack (storage battery) 4, a nose (ejection section) 5, and a magazine 6. The handle housing unit 3 can be provided so as to branch off from the fuselage housing unit 2. The battery pack 4 is detachably installed at an end of the handle housing unit 3 and is electrically connected to an electric motor 7 (refer to FIGS. 2 and 3). The nose 5 is provided at the tip (lower end) in a fastener driving direction of the fuselage housing unit 2. The magazine 6 is loaded with fasteners (nails) 23 that are connected together and supplies the fasteners 23 one at a time to within an ejection section path 5*a* of the nose 5.

A plunger 8, a coil spring (compression spring) 9, the motor 7, a reduction mechanism unit 80 (refer to FIG. 3), and a spring compression release mechanism unit 81 (simply referred to as "spring compression mechanism unit" in the following) (refer to FIG. 3) are built into the fuselage housing unit 2. The coil spring 9 provides striking power (firing power) to the plunger 8 and the reduction mechanism unit 80 reduces the rotation of the motor 7 and outputs a large torque. The spring compression mechanism unit 81 is driven by the motor 7, and compresses and releases the coil spring 9. As described in the following, the spring compression mechanism unit 81 includes a wire 16, a drum (rotating body) 13, a drum hook 22, a pin support plate 21, a power transmission pin 17, and a guide plate 18.

Figure 3:
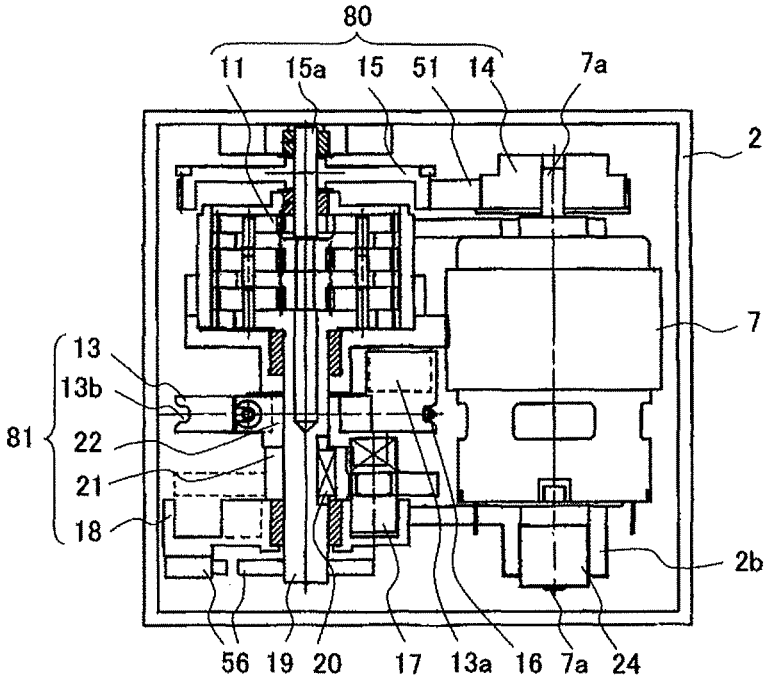
FIG. 3 is a rear view including a partial cross-section of the fastener driving tool shown in FIG. 1.

As shown in FIG. 1, the handle housing unit 3 takes a side of the fuselage housing unit 2 as a base and extends from the outer periphery of the fuselage housing unit 2. A trigger switch 10 is provided at the base. The trigger switch 10 controls a drive of the motor 7 which is electrically connected to a control circuit device (circuit substrate) 50 of the motor 7. The battery pack 4 is installed at an end of the handle housing unit 3. The battery pack 4 supplies electrical power to the motor 7 using wiring provided within the handle housing unit 3. The motor control circuit device 50 has a semiconductor switching element (FET) (not shown) built-in for turning the current of the motor 7 on and off. As shown in FIG. 3, the motor control circuit device 50 is electrically connected to a motor stopping switch 56 that senses a rotation angle of the a rotation output shaft 19 (rotating shaft of the drum 13) of the spring compression mechanism unit 81 and controls a stopping position of the motor 7. The motor stopping switch 56 includes a switch unit fixed to the guide plate 18 (fuselage housing unit 2) and a micro switch installed at the rotation output shaft 19 including rotation thrust pieces that make the switch unit go on or off at prescribed rotation angles of the rotation output shaft 19. A control signal for whether the motor stopping switch 56 is on or off is inputted to the motor control circuit device 50.

As shown in FIG. 1, the magazine 6 has one end position that the nose 5 and another end position that the handle housing unit 3. A large number of nails 23 that are the fasteners are loaded one next to another within the magazine 6 in the direction of extension of the magazine 6. The consecutive nails 23 are pushed to the side of the nose 5 by a feeding member 6*a* so that the ends of the consecutive nails 23 are positioned within the ejection section path 5*a* of the nose 5. As a result, the nail 23 positioned within the ejection section path 5*a* receives an impact to the tip of the blade 8*a* while the tip of the blade 8*a* moves within the ejection section path 5*a* of the nose 5. The nail 23 is then pushed out from an ejection opening of the nose 5 so as to be driven into the member to be fastened (not shown). The struck nail is then accelerated by the plunger 8 (blade 8*a*) up to making contact with the member to be fastened as a result of making the length of the ejection section path 5*a* of the nose 5 longer than the length of the driven nail. It is therefore possible to provide the nail 23 with a strong striking power.

A push switch 55 can be provided at the tip of the nose 5. The push switch 55 then detects that the tip of the nose 5 is substantially in contact with the member to be fastened. The push switch 55 also functions as an operation switch for controlling driving of the motor at the motor control circuit device 50 of the motor 7 with the trigger switch 10 and inputs a control signal that is off or on to the motor control circuit device 50 of the motor 7.

As shown in FIG. 1, the plunger 8 is arranged so as to be capable of being moved vertically both upwards (arrow A) or downwards (arrow B) between an upper dead point and a lower dead point within the fuselage housing unit 2. The plunger 8 has a blade (driver bit) 8*a*. When the plunger 8 moves to the side of the lower dead point, the tip of the blade 8*a* extends to as far as the tip of the ejection section path 5*a* defined within the nose 5 that the nail 23 is loaded into. The coil spring 9 is then installed in a compressed state between an upper surface section of a plunger plate 8*b* of the plunger 8 on the upper dead point side and a wall section 2*a* of the spring compression mechanism unit 81 described later. The spring 9 is then compressed when the plunger 8 is wound to the side of the upper dead point as a result of the wire 16 is wound up by the spring compression mechanism unit 81. This means that the plunger 8 is pushed by a strong urging force in the direction B (driving direction) of the lower dead point side.

As shown in FIG. 3, the reduction mechanism unit 80 is connected to the motor 7. The reduction mechanism unit 80 includes a first pulley 14 fitted to a rotation output shaft 7*a* of the motor 7, a belt 51, a second pulley 15, and a planetary gear unit 11. The first pulley 14 and the second pulley 15 constitute a first reduction unit that reduces the rotation of the rotation output shaft 7*a* of the motor 7 using the rotation of a rotation output shaft 15*a* of the second pulley 15. The planetary gear unit 11 includes a rotation input shaft 15*a* that is coaxial with the rotation output shaft 15*a* of the second pulley 15. The planetary gear unit 11 constitutes a second reduction unit that reduces rotation of the rotation output shaft 15*a* of the second pulley 15 using rotation of the rotation output shaft 19 of the planetary gear unit 11. As described in the following, the drum 13 is driven by a rotation force obtained through reduction at the rotation output shaft 19 of the planetary gear unit 11 (second reduction unit). The drum 13 winds up the wire 16 so as to move the plunger 8 to the upper dead point side. The reduction mechanism unit 80 reduces the rotation of the rotation output shaft 7*a* of the motor 7 and transmits the rotation to the rotation output shaft 19 of the drum 13. The torque (rotational power) of the motor 7 is therefore amplified at the rotation output shaft 19 of the drum 13 as a result of this reduction. The compression mechanism for the spring 9 can therefore be applied to a small type motor taken as the motor 7. For example, a reduction ratio between the rotation output shaft 7*a* of the motor 7 and the rotation output shaft 19 (rotation output shaft 19 of the reduction mechanism unit 80) of the drum 13 is 150 to 300.

As shown in FIG. 3, according to this embodiment, the one-way clutch (reverse rotation prevention mechanism) 24 is provided between the other end of the rotation output shaft 7*a* of the motor 7 and a fitting unit 2*b* of the fuselage housing unit 2. The one-way clutch 24 can then be fixed to the fitting unit 2*b* of the fuselage housing unit 2. The one-way clutch 24 then permits the motor 7 to rotate only in the forward rotation direction (direction A) and prevents the motor 7 from rotating in the opposite direction of rotation (direction B). Namely, when a torque is applied to the rotation output shaft 7*a* of the motor 7 that makes the drum 13 rotate in the direction B which is opposite to the direction A of winding up the wire 16, a function is provided that overcomes this kind of reverse rotation torque so as to prevent rotation in the opposite direction B. When a rotation torque in the forward direction A is applied, rotation (idling) in the forward direction A with respect to the torque of a loss torque or more is permitted.

Figure 11A:
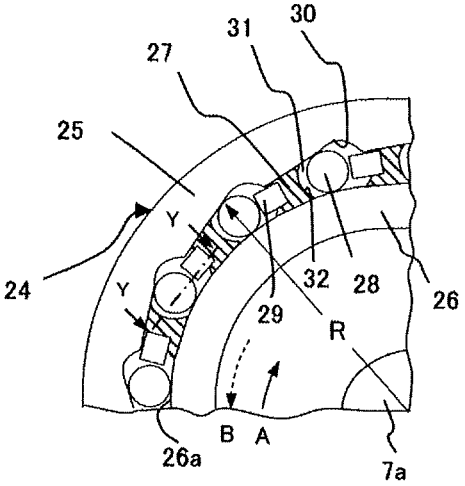
FIG. 11A is a plan view of the embodiment of a one-way clutch constituting the fastener driving tool shown in FIG. 3.
Figure 11B:
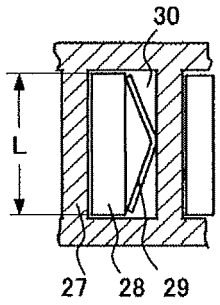

As shown in FIGS. 11A and 11B, it is preferable to use a well-known roller type one-way clutch as the one-way clutch 24. The roller-type one-way clutch 24 includes an outer ring fixing unit 25 fixed to the fitting unit 2*b* (refer to FIG. 3) of the fuselage housing unit 2, an inner ring rotation unit 26 fitted to the rotation output shaft 7*a* of the motor 7, a plurality of cam surfaces (recessed surfaces) 30 provided at regular intervals along the peripheral surface of the inner diameter of the outer ring fixing unit 25, and a wedge-shaped hollow 31 formed between each of the cam surfaces 30 and the outer peripheral surface 26*a* of the inner ring rotation unit 26. A roller 28, a plate spring 29, and a support member 27 for supporting the roller 28 and the plate spring 29 are incorporated in the wedge-shaped hollow 31. The support member 27 locks the outer ring fixing unit 25 so as not to rotate in accompaniment with rotation of the inner ring rotation unit 26. The roller 28 and the plate spring 29 are housed in a pocket 32 of the support member 27. The plate spring 29 is incorporated so as to push the roller 28 towards a narrow width section (a portion narrowing at the recess surface 30) of the wedge-shaped hollow 31. The operation of the one-way clutch 24 is as follows.

When it is intended to rotate the inner ring rotation unit 26 in the reverse rotation direction (anti-clockwise direction) B as shown in FIG. 11A, the roller 28 moves in the reverse rotation direction B of the wedge-shaped hollow 31 as a result of the urging force of the plate spring 29 and frictional force between a cylindrical outer peripheral surface 26*a* of the inner ring rotation unit 26 and the roller 28. The roller 28 is then engaged between the cam surface 30 of the outer ring fixing unit 25 and the cylindrical outer peripheral surface 26*a* of the inner ring rotation unit 26 at the narrow width section of the wedge-shaped hollow 31. The inner ring rotation unit 26 therefore effectively engages with the outer ring fixing unit 25 via the roller 28. The rotation torque of the inner ring rotation unit 26 is transmitted from the cylindrical outer peripheral surface 26*a* of the inner ring rotation unit 26 to the outer ring fixing unit 25 via the roller 28. The so-called allowable torque that prevents rotation in the reverse rotation direction B is defined by the contact surface pressure between the outer ring fixing unit 25 and the roller 28 and between the inner ring rotation unit 26 and the roller 28, the number of rollers 28, and a radius R from the rotation output shaft 7*a* (center shaft) of the inner ring rotation unit 26 to the roller 28.

This is to say that in cases where it is necessary to make the spring force (spring energy) large in order to drive in long or thick nails, it is necessary to make the contact surface area large in order to make the allowable torque large. In order to achieve this, measures can be adopted such as making the shaft length L (refer to FIG. 11B) of the roller 28 long, or making the number of rollers 28 built-in large. On the other hand, it is also possible to consider making a radius of rotation R from the rotation output shaft 7*a* of the inner ring rotation unit 26 to the roller 28 large in order to make the allowable torque large. However, when these countermeasures are adopted, the structure for the one-way clutch becomes both large and heavy. According to this embodiment, the one-way clutch 24 is provided at the rotation output shaft 7*a* of the motor 7, i.e. at the rotation input shaft side of the reduction mechanism unit 80. As a result, it is possible to make the allowable torque in order to prevent rotation in the reverse rotation direction B of the motor 7 much smaller compared to the case where the one-way clutch 24 is installed at the side of the rotation output shaft 19 of the reduction mechanism unit 80. Namely, it is possible to adopt a roller-type one-way clutch where the allowable torque is small. This means that if a roller-type one-way clutch is used where the allowable torque is small, it is possible for the one-way clutch 24 to be made to be both small and lightweight. It is therefore possible for the tool as a whole to be both small and lightweight.

On the other hand, when it is intended to rotate the inner ring rotation unit 26 in the forward rotation direction (clockwise direction) A in FIG. 11A, the frictional force between the cylindrical outer peripheral surface 26*a* of the inner ring rotation unit 26 and the roller 28 resists the urging force of the plate spring 29 so as to cause the roller 28 to move in the direction of the broad width section of the cam surface 30 of the wedge-shaped hollow 31. This then releases the engagement between the roller 28 and the inner ring rotation unit 26. This means that the rotation of the inner ring rotation unit 26 is not prevented but rather that idling take place with respect to the outer ring fixing unit 25. The loss torque during this idling is decided by the reactive force of the plate spring 29 that presses the roller 28 in a locking direction at the narrow width section of the cam surface 30. However, power is then transmitted via the roller 28 when the inner ring rotation unit 26 engages with the outer ring fixing unit 25. The force (reactive force) of the plate spring 29 can therefore be a force of an order that pushes the roller 28 towards the wedge-shaped hollow 31 in advance. The force (reactive force) of the plate spring 29 does not depend on the allowable torque being large and it is therefore possible to make the loss torque small.

According to this embodiment, it is therefore possible to adopt a roller-type one-way clutch with a small allowable torque. The loss torque can therefore be made small by adopting a roller-type one-way clutch.

Figure 4:
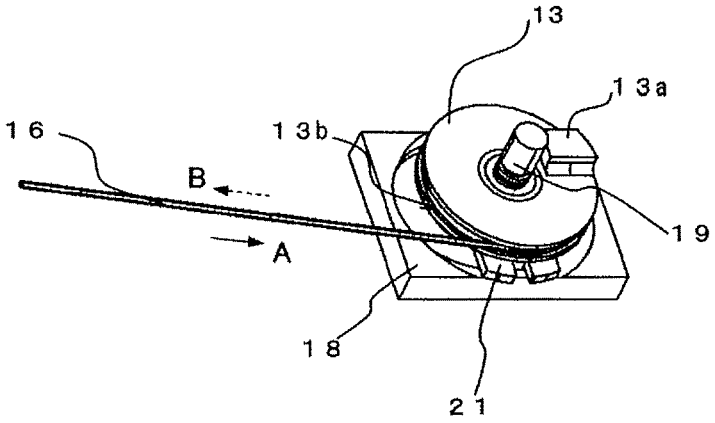
FIG. 4 is a perspective view of a spring compression mechanism constituting the fastener driving tool shown in FIG. 3.
Figure 5:
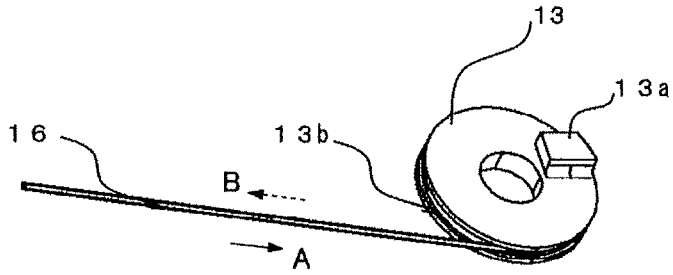
FIG. 5 is a partially enlarged perspective view of the spring compression mechanism shown in FIG. 4.
Figure 5:
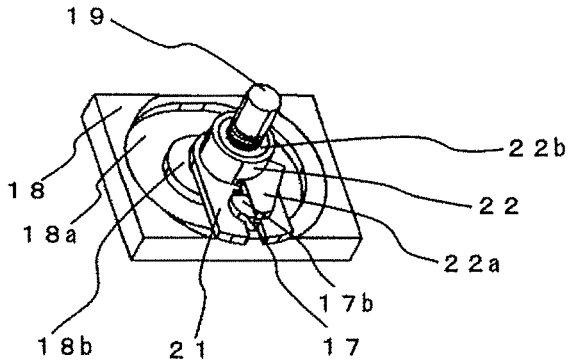
Figure 6:
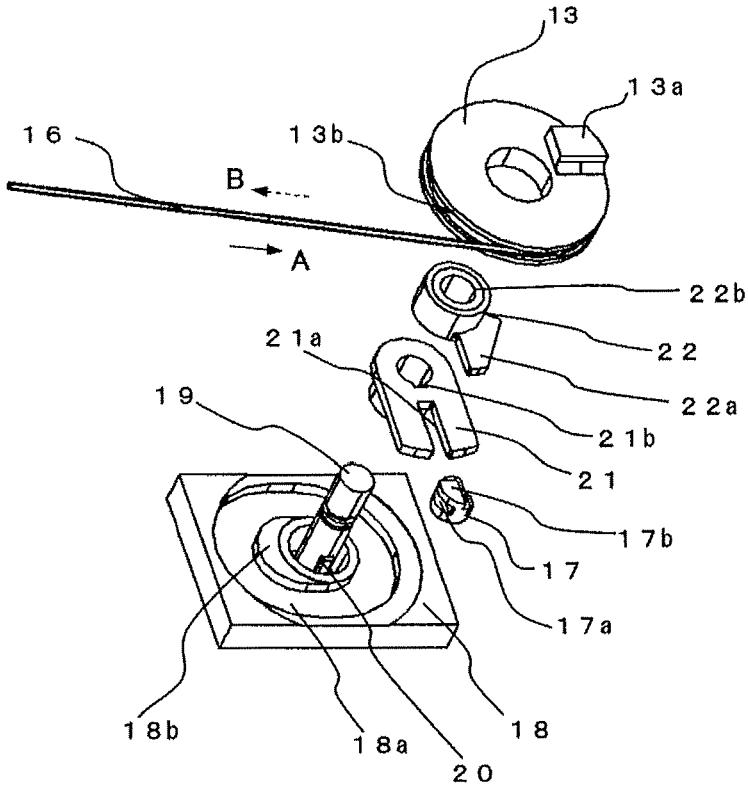
FIG. 6 is an enlarged perspective view of the whole of the spring compression mechanism shown in FIG. 4.

As shown in FIGS. 4 to 6, the spring compression mechanism unit 81 for compressing and releasing the spring 9 includes the guide plate 18, the pin support plate 21, the drum hook 22, the drum 13, the power transmission pin 17, and the wire 16. The guide plate 18 supports one end of the rotation output shaft 19 of the planetary gear unit 11. The power transmission pin 17 is supported at the pin support plate 21 in a slidable manner. The wire 16 connects the drum 13 and the plunger 8.

The wire 16 is constructed by binding a plurality of metal wiring material so as to combine both flexibility and strength. The surface of the wire 16 is coated with resin so as to prevent wear at a drum groove 13*b* (trough) making contact with the wire 16. The outer peripheral section of the cylindrical section of the drum hook 22 is press-fitted into a center hole of the drum 13 and the drum hook 22 and the drum 13 are formed integrally. A bearing (for example, a ball bearing) 22*b* is press-fitted at an inner peripheral surface of the cylindrical section of the drum hook 22 and the bearing 22*b* is installed at the rotation output shaft 19. This means that the drum 13 and the drum hook 22 both become integral and are supported so as to be rotatable with respect to the rotation output shaft 19.

The power transmission pin 17 has a pin slide section (groove) 17*a* and a pin hooking section 17*b*. The pin slide section 17*a* engages with the pin support slide section 21*a* in the possession of the pin support plate 21 so as to be slidable. The pin hooking section 17*b* engages with a hook section 22*a* of the drum hook 22. The power transmission pin 17 is arranged so that its side end surface makes contact with a wall section within a guide channel 18*a* of the guide plate 18. The direction and extent of movement of the power transmission pin 17 is controlled by the plane shape of the guide channel 18*a*. The pin hooking section 17*b* that is the other end surface of the power transmission pin 17 is installed at the same height as the height of the hook section 22*a* in the axial direction of the rotation output shaft 19. When the power transmission pin 17 rotates in synchronization with the pin support plate 21, the pin hooking section 17*b* engages with the hook section 22*a*. The pin support plate 21 has a key groove 21*b*, with a key 20 provided at the rotation output shaft 19 engaging with the key groove 21*b*. The rotation output shaft 19, the pin support plate 21, and the power transmission pin 17 are therefore configured so as to always rotate in synchronization with each other.

FIGS. 7 to 10 show the state of rotation of the drum 13 when the spring compression mechanism unit 81 is in operation. For the convenience of description, the drum 13 coupled to the drum hook 22 by press fitting is shown in a removed state in FIGS. 7 to 10.

Figure 7:
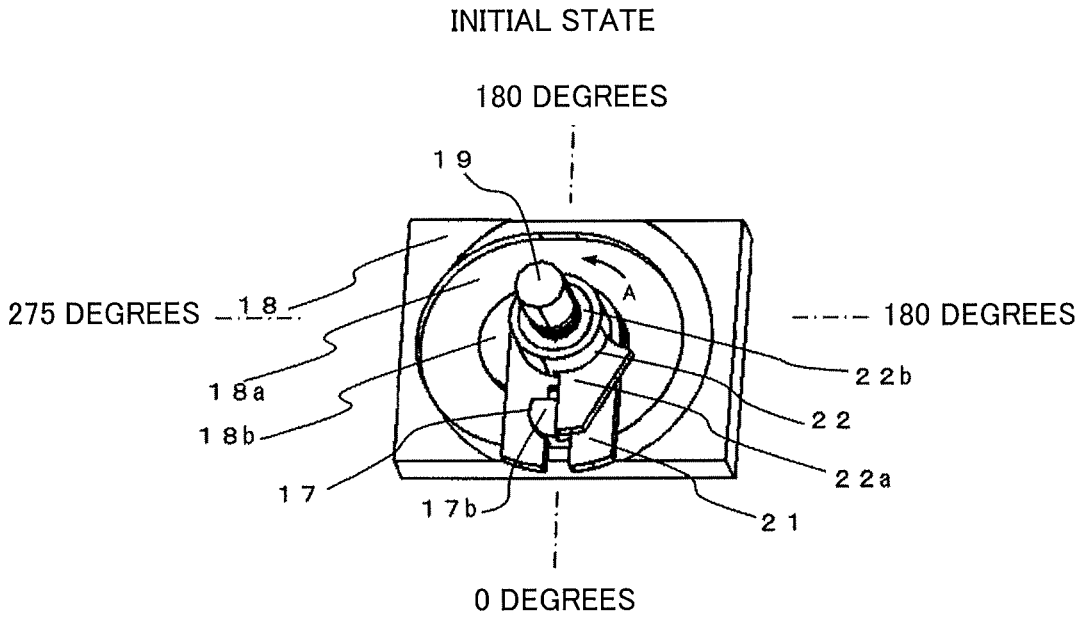
FIG. 7 is a perspective view of an initial state of the spring compression mechanism shown in FIG. 5.
Figure 8:
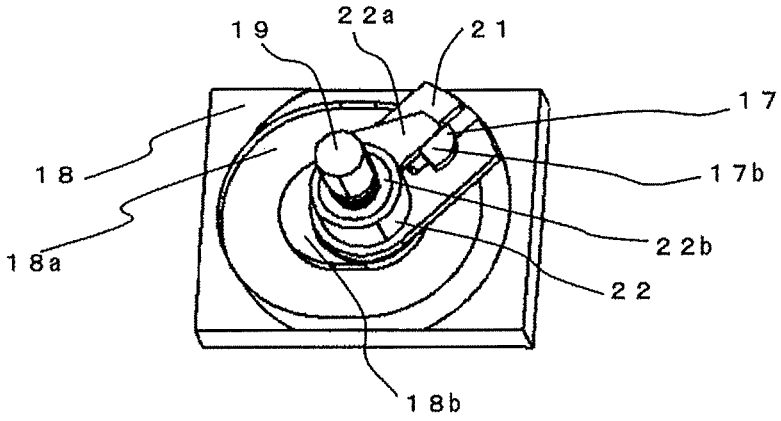
FIG. 8 is a perspective view showing the spring compression mechanism shown in FIG. 5 rotated through 135 degrees.
Figure 9:
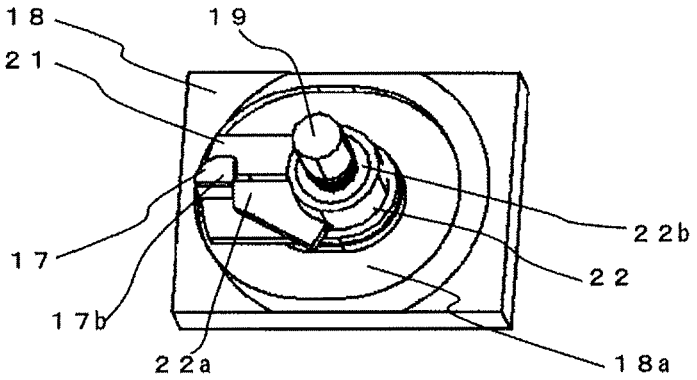
FIG. 9 is a perspective view showing the spring compression mechanism shown in FIG. 5 rotated through 270 degrees.
Figure 10:
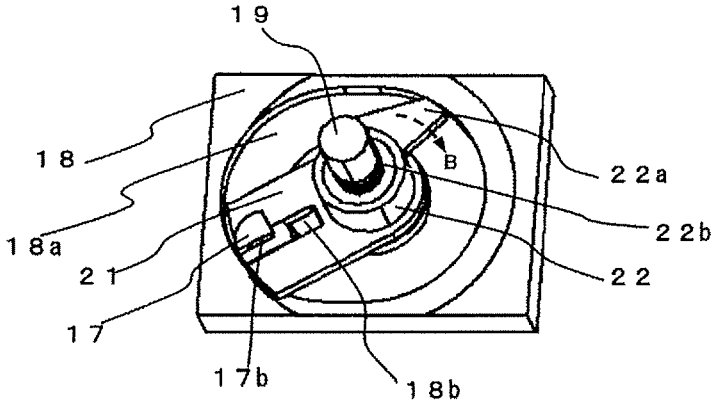
FIG. 10 is a perspective view showing the spring compression mechanism shown in FIG. 5 when rotated in reverse.

FIG. 7 shows the case where the hook section 22*a* (pin hooking section 17*b*) of the drum hook 22 is in an initial state at a position where the rotation angle is zero degrees. In this initial state, the plunger 8 is stopped at the lower dead point. FIG. 8 shows the situation when the hook section 22*a* (pin hooking section 17*b*) is rotated through approximately 135 degrees in the forward rotation direction A. FIG. 9 shows the situation when the hook section 22*a* (pin hooking section 17*b*) is rotated through approximately 270 degrees in the forward rotation direction A. FIG. 10 shows the situation where the hook section 22*a* is released from engagement with the pin hooking section 17*b* and the drum 13 is rotated in reverse in the reverse rotation direction B as a result of being urged by the spring 9 towards the plunger 8.

As a result of the above configuration, the plunger 8 urged by the spring 9 is pushed upwards to a prescribed position on the upper dead point side (upper dead point position) as a result of the action of the motor 7, the reduction mechanism unit 80, and the spring compression mechanism unit 81, while resisting the urging force (firing power) of the spring 9. The spring 9 compressed to the prescribed upper dead point position by the spring compression mechanism unit 81 is then released. The urging force (firing force) obtained at the time of release then acts on the blade 8*a* fitted to the plunger 8 so as to provide an impact force from the blade 8*a* to the nail 23 loaded in the magazine 6. The nail 23 can therefore be driven in the direction of the member to be fastened from the nose 5. Next, the operation of driving in the nail 23 is explained together with the operation of the spring compression mechanism unit 81 with reference to FIGS. 7 to 10.

When the plunger 8 is in an initial state where the plunger 8 is stopped at the lower dead point (refer to FIG. 1), the plunger 8 is pushed down to the lower dead point by the urging force of the spring 9. The pin hooking section 17*b* driven by the drum 13 that winds up the wire 16 is positioned at an angle of, for example, zero degrees (reference position) as shown in FIG. 7.

When an operator grasps the handle housing unit 3 of the fastener driving tool 1, pulls back the trigger switch 10, and presses the push switch (contact switch) 55 provided at the tip of the nose 5 against the member to be fastened, electrical power is supplied from the battery pack 4 to the motor 7 by the function of the motor control circuit device 50. The motor 7 (refer to FIGS. 2 and 3) then rotates in the forward rotation direction A. As shown in FIG. 3, the rotational force of the motor 7 is transmitted to the rotation output shaft 15*a* of the first reduction unit constituted by the first pulley 14 fitted to the rotation output shaft 7*a*, the second pulley 15, and the belt 51 wrapped across the first pulley 14 and the second pulley 15. The rotational force of the motor 7 is then transmitted to the rotation output shaft 19 by a second reducing unit constituted by the three stage planetary gear unit 11. The rotational force of the motor 7 is then transmitted to the pin support plate 21 which mechanically engaged with the rotation output shaft 19 and the power transmission pin 17. At this time, the motor 7 rotates in the forward rotation direction A. The inner ring rotation unit 26 of the one-way clutch 24 therefore idles and permits rotation of the motor 7 in the forward rotation direction A. As described above, in this embodiment, as a result of adopting the roller type one-way clutch as the one-way clutch 24, it is possible to reduce the loss torque (loss torque when rotating in the forward rotation direction A) when idling.

As shown in FIG. 7, the power transmission pin 17 and the hook section 22*a* are in engagement in the initial state of the spring compression mechanism unit 81. The pin support plate 21 therefore receives the rotational force of the motor 7 so as to rotate, and the drum hook 22 and the drum 13 rotate in the forward rotation direction A. The drum 13 then winds up the wire 16 onto a drum trough section 13*b* provided at the outer surface of the drum 13 during rotation of the drum 13 in the forward rotation direction A. When the wire 16 is wound onto the drum 13 in the direction A, the plunger 8 coupled to the end of the wire 16 is pushed upwards towards the upper dead point side against the urging force of the spring 9. The spring 9 is then compressed more by the plunger plate 8*b* provided at an upper end surface of the plunger 8.

FIG. 8 shows the situation when the hook section 22*a* is rotated through approximately 135 degrees from an initial state of the reference position shown in FIG. 7. The drum 13 is also rotated through approximately 135 degrees in synchronism with the rotation of the pin support plate 21, the wire 16 is wound up, and the spring 9 is compressed.

A side end of the power transmission pin 17 comes into contact with a guide projection 18*b* that defines an inner wall section of a guide channel 18*a* in accordance with the pin support plate 21 being rotated from this state of being rotating through 135 degrees as shown in FIG. 8 to a state of being rotating through approximately 270 degrees as shown in FIG. 9 as a result of the rotation of the motor 7. The guide projection 18*b* is substantially elliptical in shape with a planar shape that bulges by approximately 5 to 15 millimeters in a radial direction from the center of its axis of rotation. As the pin support plate 21 rotates, the power transmission pin 17 moves in a radial direction on the external shape of the guide projection 18*b* so as to become more distant than the rotation output shaft 19.

For example, when the pin support plate 21 enters a state of rotation of approximately 270 degrees (FIG. 9) from the reference state (initial state) in FIG. 7, the power transmission pin 17 moves approximately 5 to 15 millimeters in the radial direction. The connection (engagement) between the power transmission pin 17 and the hook section 22*a* is therefore released. As shown in FIG. 9, when the drum 13 is rotated through approximately 270 degrees from the initial state, the plunger 8 is lifted as far as the upper dead point by the wire 16 and the spring 9 also enters a state of maximum compression.

When the connection between the power transmission pin 17 and the hook section 22*a* is released in a state of rotation through approximately 270 degrees as shown in FIG. 9, the compressed spring 9 is released, and the plunger 8 moves towards the lower dead point side due to the force released from the spring 9 (firing force). As shown in FIG. 10, when the plunger 8 moves to the lower dead point side, the drum 13 and the drum hook 22 are pulled by the wire 16 and rotation in the opposite direction B to the forward rotation direction A of the rotation output shaft 19 commences.

When the drum 13 is rotated in reverse in the direction B by the force released from the compressed spring 9 so that the plunger 8 reaches the lower dead point, the blade 8*a* fitted to the end of the plunger 8 passes through the ejection section path 5*a* of the nose 5 and can therefore drive the nail 23 towards the member to be fastened. In this event, when the spring 9 is released and the plunger 8 reaches the lower dead point, a drum damper engaging section 13*a* of the drum 13 engages with a drum damper 13*c* shown in FIG. 2 and the reverse rotation of the drum 13 is stopped.

When the drum 13 returns to the initial state, the drum damper engaging section 13*a* engages with the drum damper 13*c* fixed within the fuselage housing unit 2, and the drum 13 and the drum hook 22 are fixed in the initial position (reverse rotation stop position).

After the nail 23 is driven in, the power transmission pin 17 and the hook section 22*a* are re-engaged at the reverse rotation stop position of the drum 13, and the drum 13 again rotates forwards in the direction A so that the wire 16 is wound in. This means that the plunger 8 is pulled and the spring 9 is compressed again. The supply of electrical power from the battery pack 4 to the motor 7 by the circuit function of the motor control circuit device 50 is therefore stopped and rotation of the motor 7 is stopped.

It is preferable for the stopping of the motor 7 to take place after a prescribed time elapses from the detection of the time of driving by the motor stopping switch 56 (refer to FIG. 3) etc., or after detecting a prescribed rotation angle in the forward rotation direction of the drum 13. Even if the motor 7 stops, it is taken that the drum 13 will continue to rotate as a result of the rotational inertia of the rotor (not shown) of the motor 7, the planetary gear unit 11, and the rotation output shaft 19 etc. This means that as described previously, stopping takes place while the drum 13 rotates, the plunger 8 is pushed upwards, and the spring 9 is further compressed.

Energy of the rotational inertia of the rotor of the motor 7, the first pulley 14, the second pulley 15, the planetary gear unit 11, and the rotation output shaft 19 etc. is converted to energy for compressing the spring 9. However, as the rotational inertia energy approaches zero, when rotation of the drum 13 in the forward direction A falls to zero, on this occasion, the urging force of the spring 9 attempts to cause the drum 13 to rotate in the reverse rotation direction B and the rotor of the motor 7, the planetary gear unit 11, and the rotation output shaft 19 also attempt to rotate together with the drum 13.

When the released spring 9 then becomes extended to a certain extent, the reverse torque due to the urging force of the spring 9 becomes smaller than the loss torque of sliding sections and rotating axes etc. of the motor 7, the planetary gear unit 11, the rotation output shaft 19, and the plunger 8. The drum 13 therefore does not rotate in reverse. However, in a state where the plunger 8 is pushed up, and the spring 9 is compressed to a certain extent, the torque due to the urging force of the spring 9 is larger. This means that the drum 13 fitted to the rotation output shaft 19 rotates in reverse.

At this time, the reverse rotation prevention member such as the roller 28 of the one-way clutch 24 provided at one end of the rotation output shaft 7*a* of the motor 7 resists the reverse rotation force so as to engage with the fitting section 2*b* of the fuselage housing unit 2 via the outer ring fixing unit 25 of the one-way clutch 24. This means that reverse rotation of the rotor of the motor 7, the first pulley 14, the second pulley 15, the planetary gear unit 11, the rotation output shaft 19, and the drum 13 is prevented. When the plunger 8 is in a state of being pulled to a certain extent in resistance to the urging force of the spring 9, the plunger 8 is stopped at a position at a prescribed height from the lower dead point. It is therefore possible to obtain the following effects as a result of the installation of a one-way clutch in accordance with the present invention.

(1) According to the above embodiment, the one-way clutch 24 is installed between the rotation input shaft 15*a* of the reduction mechanism unit 80 and the rotation output shaft 7*a* of the motor 7. This means that it is possible to make the allowable torque in order to prevent reverse rotation of the drum 13 small. The structure of the one-way clutch 24 can also be made small and lightweight. Namely, the torque applied at the rotation output shaft 19 with the drum 13 in a stopped state is the product of the urging force of the spring 9 and a winding radius of the wire 16 of the drum 13, for example, 10 to 40 Nm. At this time, the torque (torque in the reverse rotation direction) occurring at the rotation output shaft 7*a* of the motor 7 is reduced by the pulley ratio of the first pulley 14 and the second pulley 15 and the reduction ratio of the planetary gear unit 11 and therefore becomes smaller than the torque of the rotation output shaft 19. It is therefore possible to make the allowable torque (torque preventing reverse rotation) of the one-way clutch 24 coupled to the rotation output shaft 7*a* of the motor 7 small. The reverse rotation prevention member constituting the one-way clutch 24 can therefore be made small, as can the whole of the one-way clutch 24. As described above, a reduction ratio at the reduction mechanism unit 80 is 150 to 300. The torque at the rotation output shaft 7*a* of the motor 7 at this time therefore becomes, for example, 0.033 to 0.27 Nm, which is extremely small compared to the torque of 10 to 40 Nm of the drum 13. However, it is preferable to put in place a safety factor of a maximum restricted torque used of 20 times in order to take into consideration the prevention of damage to the one-way clutch due to impact torque. For example, in the above embodiment, it is therefore preferable to use a one-way clutch having an allowable torque of up to 5.4 Nm that is 20 times the maximum restricted torque use of 0.27 Nm.

(2) It is possible for the stop position of the plunger 8 to be moved by 5 to 30 millimeters from the upper dead point by the one-way clutch 24. It is therefore possible to make the drive time from the start of operation activated by using a driving switch such as a trigger switch or a push switch etc. until driving short. As a result, it is possible to increase working efficiency, and it is possible to improve the so-called driving feeling by driving nails at the same time as operating the driving switch.

(3) It is possible to use a one-way clutch 24 with a small allowable torque. It is therefore possible to reduce loss torque of the one-way clutch 24 when the drum 13 is rotated in the forward rotation direction A. As a result, it is possible for inertial energy of the drum 13 after driving the nail 23 to continue to be used as compression energy of the spring 9 for driving the nails. It is therefore possible to achieve improved efficiency for the battery pack 4 and the number of nails that can be driven per one charging of the battery pack 4 can therefore be increased. In this event, and in particular, if a roller type of one-way clutch is used, it is possible to further reduce the loss when driving in the nails and the driving efficiency of the battery pack can therefore be further improved.

When the one-way clutch 24 is installed at the rotation output shaft 7*a* of the motor 7, the inner ring rotation unit 26 of the one-way clutch is connected to the rotation output shaft 7*a* of the motor 7. It is therefore possible to make the allowable rotational speed of the motor high and a high output can be obtained as a result.

(4) By installing the one-way clutch 24, when the plunger 8 is stopped, the tip of the blade 8*a* fitted to the plunger 8 can be positioned more closer to the side of the upper dead point than the head of the nail 23 loaded in the ejection section path 5*a* of the nose 5. If the rotation output shaft 19 then rotates in reverse more than is necessary, it is possible that the nail 23 will be pushed by the blade 8*a* so as to be ejected or released from the ejection section path 5*a* of the nose 5. It is therefore possible to stop the plunger 8 at a more appropriate position by installing the one-way clutch 24 and the unnecessary ejection or release of nails 23 can be prevented.

As becomes clear from the above description of the embodiment, according to the present invention, by providing a one-way clutch between an input side rotating shaft of a reduction mechanism unit and a rotation output shaft of a motor, it is possible to prevent reverse rotation of a rotating drum due to urging force in a downward direction of the spring using a one-way clutch with a small allowable torque. A stop position of the rotating drum can therefore be set to a desired position. It is therefore possible for the fastener driving tool to be made both small and lightweight, and for both working efficiency and driving feeling to be improved.

Figure 13:
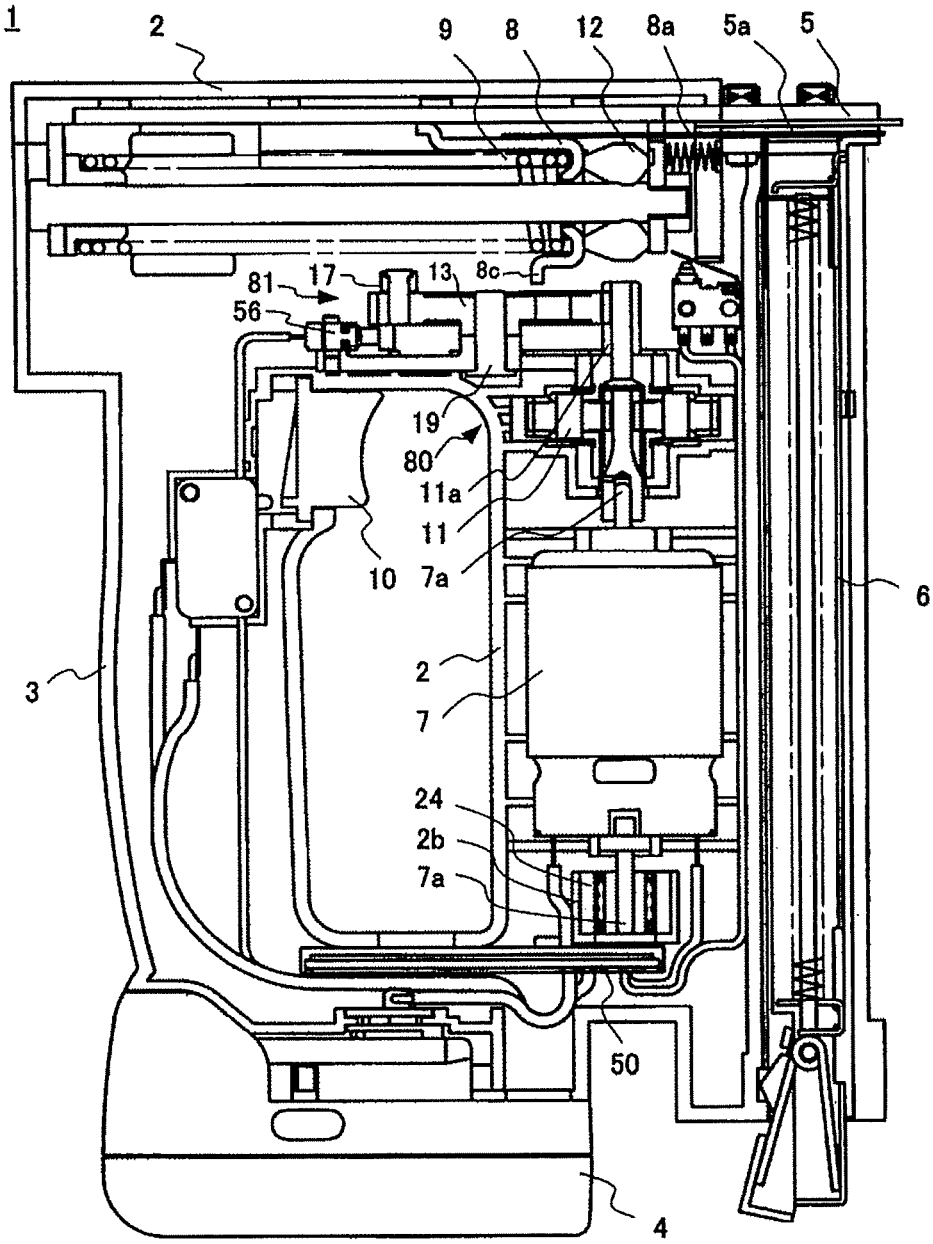
FIG. 13 is a side view including a partial cross-section of a fastener driving tool of another embodiment of the present invention.

FIG. 13 shows an overall structural view (cross-sectional view) of a fastener driving tool 1 of another embodiment of the present invention. The fastener driving tool 1 has a structure that supplies staples (not shown) as fasteners from the magazine 6 to the ejection section path 5*a* of the nose 5. The staples are then driven into the member to be fastened (not shown) by the blade 8*a*. The fuselage housing unit 2 includes a portion extending in the direction of reciprocation of the plunger 8, and a portion extending parallel with the handle housing unit 3. The magazine 6 extends in a direction orthogonal to the direction of reciprocation (vertical direction of movement) of the blade 8*a* so as to supply staples (fasteners) to the ejection section path 5*a*. The motor 7 and the planetary gear unit 11 of the reduction mechanism unit 80 are installed within the fuselage housing unit 2. A rotating shaft for the motor 7 and the planetary gear unit 11 is parallel with the extension direction of the handle housing unit 3. The rotating body 13 constituted by a gear meshes with a pinion gear 11*a* of the reduction mechanism unit 80 (planetary gear unit 11) and transmits the rotational output of the reduction mechanism unit 80 to a plunger hook 8*c* via the power transmission pin 17. The power transmission pin 17 of the rotating body 13 engages with the plunger hook 8*c* at the time of fastener driving and the spring 9 is compressed to the upper dead point side. At the time when the plunger 8 reaches the upper dead point side, the engagement of the power transmission pin 17 and the plunger hook 8*c* is released. The blade 8*a* then strikes the staple (fastener) loaded at the ejection section path 5*a* of the nose 5 due to the urging force of the compressed spring 9 and the staple is driven into the member to be fastened.

After the plunger 8 moves to the lower dead point, the power transmission pin 17 again engages with the plunger hook 8*c* and rotation of the motor 7 is stopped. In this case, because the one-way clutch 24 is provided, unnecessary reverse rotation of the motor 7 after stopping due to the urging force of the spring 9 can be prevented. The one-way clutch 24 is connected to one end (the lower end) of the rotation output shaft 7*a* of the motor 7. It is therefore possible to adopt a small one-way clutch, and the effects of the present invention can be obtained as with the embodiment shown above in FIG. 3.

Figure 12A:
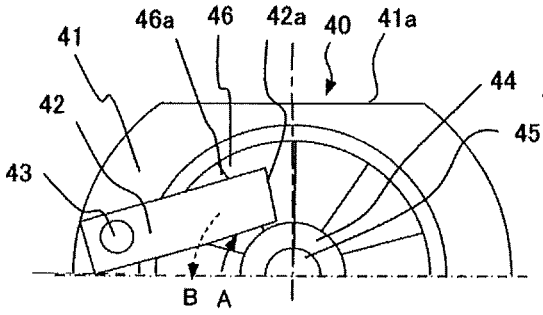
FIG. 12A is a plan view of a modified example of the one-way clutch constituting the fastener driving tool shown in FIG. 3.
Figure 12B:
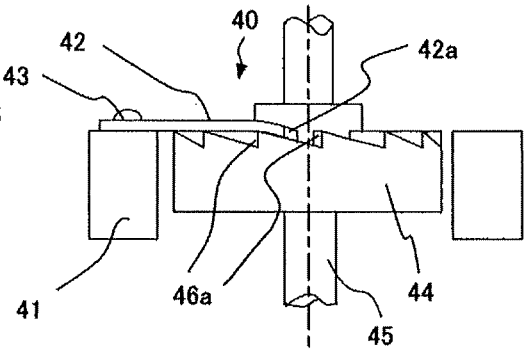
FIG. 12B is a side cross-section of the modified example of the one-way clutch constituting the fastener driving tool shown in FIG. 3.

In the above embodiment, an explanation is given of the case where the one-way clutch 24 is a roller type clutch. However, the present invention can also use a ratchet type clutch as the one-way clutch. FIGS. 12A and 12B show an example of a ratchet-type one-way clutch. A ratchet (pawl) 46 is formed on the upper surface of an inner ring rotation unit 44 where a rotating shaft 45 is coupled to the rotation output shaft 7*a* of the motor 7. A plate spring (reverse rotation prevention member) 42 is fitted using a screw 43 to an outer ring fixing unit 41 with an end surface 41*a* that stops rotation with respect to the fitting section 2*b* of the fuselage housing unit 2. The plate spring is postured so as to press against the ratchet section 46 of the inner ring rotation unit 44. In FIG. 12A, the inner ring rotation unit 44 idles when the inner ring rotation unit 44 (rotation output shaft 7*a* of the motor 7) rotates in the forward rotation direction A. When the rotation output shaft 7*a* of the motor 7 and the inner ring rotation unit 44 attempt to rotate in the reverse rotation direction (direction B), a plate spring end 42*a* meshes a ratchet tooth section 46*a* and reverse rotation is prevented. According to this embodiment of the present invention, a ratchet type one-way clutch is also fitted to the rotation output shaft 7*a* of the motor 7. The same results as for the other embodiments can therefore also be obtained.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2008-005465 filed on Jan. 15, 2008 and including specification, claims, drawings and summary. The disclosure of the above Japanese Patent Application is incorporated herein by reference in its entirety.

What is claimed is:

1. A fastener driving tool comprising:

a motor having two end faces and a rotation output shaft extending through the end faces;

a magazine that supplies fasteners;

a plunger, provided to move up and down between an upper dead point and a lower dead point, and having a blade for driving the fasteners;

a spring that urges the plunger downwards, and that is capable of being compressed upwards;

a spring compression mechanism unit having a rotating body that moves the plunger in a direction of compressing the spring based on rotation of the rotation output shaft of the motor in one direction;

a reduction mechanism unit provided between the rotation output shaft of the motor and the rotating body, having a first rotating input shaft that is driven by the motor and a rotation output shaft connected to the rotating body to transmit a reduced rotational speed of the first rotating input shaft to the rotating body; and a one-way clutch provided between the rotation output shaft of the motor and the first rotating input shaft of the reduction mechanism unit, that permits rotation of the motor in the one direction that compresses the spring, and prohibits the rotation of the motor in an opposite direction, wherein the one-way clutch is connected to one end of the rotation output shaft located at one end face of the motor, and the first rotating input shaft of the reduction mechanism unit is connected to another end of the rotation output shaft located at the other end face of the motor.

2. The fastener driving tool according to claim 1, wherein the reduction mechanism unit reduces a rotational speed of the rotation output shaft of the motor and transmits the reduced rotational speed to the rotating body.

3. The fastener driving tool according to claim 1, wherein the one-way clutch comprises:

an inner ring rotation unit connected to the rotation output shaft of the motor;

an outer periphery fixing unit provided at an outer periphery of the inner ring rotation unit; and an engaging member configured to engage between the inner ring rotation unit and the outer periphery fixing unit, to permit rotation of the inner ring rotation unit in only one direction.

4. The fastener driving tool according to claim 1, wherein the one-way clutch is a roller-type one-way clutch.

5. The fastener driving tool according to claim 1, wherein the one-way clutch is a ratchet-type one-way clutch.

6. The fastener driving tool according to claim 1, wherein the allowable torque of the one-way clutch is set to a range of 5.4 Nm or less.

* * * * *